US007966986B2

(12) United States Patent
Schmidt

(10) Patent No.: US 7,966,986 B2
(45) Date of Patent: Jun. 28, 2011

(54) CYLINDER HEAD

(75) Inventor: Michael Paul Schmidt, Howell, MI (US)

(73) Assignee: Hyspan Precision Products, Inc., Chula Vista, CA (US)

( * ) Notice: Subject to any disclaimer, the term of this patent is extended or adjusted under 35 U.S.C. 154(b) by 486 days.

(21) Appl. No.: 12/082,732

(22) Filed: Apr. 14, 2008

(65) Prior Publication Data

US 2008/0276899 A1 Nov. 13, 2008

Related U.S. Application Data

(60) Provisional application No. 60/923,211, filed on Apr. 13, 2007.

(51) Int. Cl.
*F02F 1/42* (2006.01)

(52) U.S. Cl. ..... 123/193.5; 60/322; 60/323

(58) Field of Classification Search ..... 123/193.5; 29/890.08, 888.06, 888.061; 60/322, 323
See application file for complete search history.

(56) References Cited

U.S. PATENT DOCUMENTS

| | | | | |
|---|---|---|---|---|
| 2,611,238 | A * | 9/1952 | Fryer, Jr. | 60/322 |
| 2,694,583 | A | 11/1954 | Zitza et al. | |
| 3,517,536 | A | 6/1970 | Fitzmaurice | |
| 3,635,031 | A | 1/1972 | Haddad | |
| 3,898,803 | A | 8/1975 | Sasaki et al. | |
| 3,899,300 | A | 8/1975 | D'Olier | |
| 3,940,927 | A | 3/1976 | Maurhoff et al. | |
| 3,983,696 | A | 10/1976 | Pflugfelder | |
| 4,031,699 | A | 6/1977 | Suga et al. | |
| 4,055,043 | A | 10/1977 | Konishi et al. | |
| 4,195,477 | A | 4/1980 | Yamazaki et al. | |
| 4,430,856 | A | 2/1984 | Niedert | |
| 4,879,980 | A * | 11/1989 | Piazzo | 123/193.5 |
| 4,884,400 | A | 12/1989 | Tamaka et al. | |
| 5,197,189 | A * | 3/1993 | Schreiber et al. | 29/888.061 |
| 5,207,210 | A | 5/1993 | Yamagata et al. | |
| 5,463,867 | A | 11/1995 | Ruetz | |
| 5,606,857 | A | 3/1997 | Harada | |
| 5,809,778 | A * | 9/1998 | Nording | 60/323 |
| 6,055,970 | A * | 5/2000 | Takahashi | 123/672 |
| 6,161,379 | A | 12/2000 | Haselkorn et al. | |
| 6,629,516 | B1 | 10/2003 | Minemi et al. | |
| 6,776,128 | B2 | 8/2004 | Baba et al. | |
| 2001/0018827 | A1 | 9/2001 | Rhode et al. | |
| 2002/0104504 | A1 | 8/2002 | Suzuki et al. | |
| 2006/0011153 | A1 | 1/2006 | Yamazaki | |
| 2007/0062478 | A1 | 3/2007 | Netsu et al. | |

FOREIGN PATENT DOCUMENTS

| | | | |
|---|---|---|---|
| DE | 4128544 A1 | * | 3/1992 |
| EP | 309418 A2 | * | 3/1989 |
| JP | 2000161132 | * | 6/2000 |

OTHER PUBLICATIONS

International Search Rep, Aug. 8, 2008, Metaldyne Company LLC.

* cited by examiner

*Primary Examiner* — Michael Cuff
*Assistant Examiner* — Hung Q Nguyen
(74) *Attorney, Agent, or Firm* — McDonald Hopkins LLC

(57) ABSTRACT

An exhaust system includes a cylinder head having a plurality of exhaust ports. Integrally formed with the cylinder head are a plurality of independent and separate tubes. The tubes are cast, molded or otherwise integrally formed with the exhaust ports of the cylinder head. The cylinder head and tubes eliminate the need for an exhaust flange, welding the tubes to the exhaust flange and securing the exhaust flange to the cylinder head. As a result, the exhaust system has less weight and improved performance over prior art cylinder head and exhaust assemblies.

10 Claims, 1 Drawing Sheet

CYLINDER HEAD

CROSS-REFERENCE TO RELATED APPLICATIONS

This application claims priority from U.S. Provisional Patent Application No. 60/923,211 entitled "Cylinder Head," filed on Apr. 13, 2007, which is hereby incorporated by reference in its entirety.

FIELD OF THE INVENTION

This invention relates to a cylinder head of an internal combustion engine, and more particularly to a cylinder head with an improved exhaust manifold connection.

BACKGROUND

In an internal combustion engine, the cylinder head is positioned on the top of the engine block. The cylinder head provides upper portions of each combustion chamber, where each upper portion corresponds to one cylinder of the engine block. The cylinder head may house intake valves, exhaust valves, camshafts, rocker arms and pushrods, and numerous other mechanisms as known in the art.

An intake manifold and an exhaust manifold are typically coupled to the cylinder head. The intake manifold is located between the carburetor and cylinder head. In use, the intake manifold supplies an air-fuel mixture through internal intake ports in the cylinder head to each combustion chamber. In multi-port injected engines, the intake manifold holds fuel injectors that supply an air-fuel mixture to each combustion chamber.

The exhaust manifold is typically coupled to the side of the cylinder head opposite the intake manifold (i.e. the "exhaust side"). The exhaust manifold collects exhaust gases exiting from each combustion chamber through internal exhaust ports in the cylinder head and transfers these exhaust gases to an exhaust pipe of an exhaust system. The exhaust manifold has a plurality of primary pipes in fluid communication with a common exhaust pipe. Each primary pipe is coupled to the cylinder head over the outlet of a corresponding exhaust port such that each primary pipe collects exhaust gases exiting a corresponding combustion chamber and transfers them to the exhaust pipe.

The inlet end of each primary pipe is welded to a manifold inlet flange, which is subsequently bolted to the cylinder head. Since exhaust manifolds are generally constructed of cast iron, the inlet flange is relatively heavy and adds a substantial amount of weight to the engine. In addition, welding the primary pipes to the flange is difficult and complicated as it is necessary to provide a weld about the circumference of each pipe. Since there are usually a number of pipes, adjacent pipes interfere with each other during welding. Thus, welding about the entire circumference of each tube is difficult, expensive and time consuming.

Furthermore, once the primary pipes are welded to the flange, a separate machining or smoothing of the flange is required in order to ensure that the cylinder head contacting surface of the flange is smooth and flat, thereby allowing for the secure formation of a sealing attachment of the flange to the cylinder head. The exhaust side of the cylinder head requires similar machining or smoothing in order to provide a corresponding smooth and flat contacting surface of the cylinder head. Since the machining of these materials is difficult and time consuming, the overall cost of producing the engine is higher. Moreover, even with the machining or smoothing of the surfaces, a manifold gasket is required to ensure a good seal between the cylinder head and exhaust manifold. Further, this manifold gasket adds additional weight to the engine, and, over time, the manifold gasket may fail requiring expensive replacement.

Consequently, there exists a significant need for a cylinder head which will provide a reduction in overall engine manufacture time and cost as well as a reduction in engine weight.

DESCRIPTION OF THE DRAWING

The accompanying drawing, which is incorporated in and constitutes a part of this specification, illustrates an embodiment of the invention, and, together with the detailed description of the embodiment given below, serves to explain the principles of the present invention, and in which.

DETAILED DESCRIPTION

Figure 1:
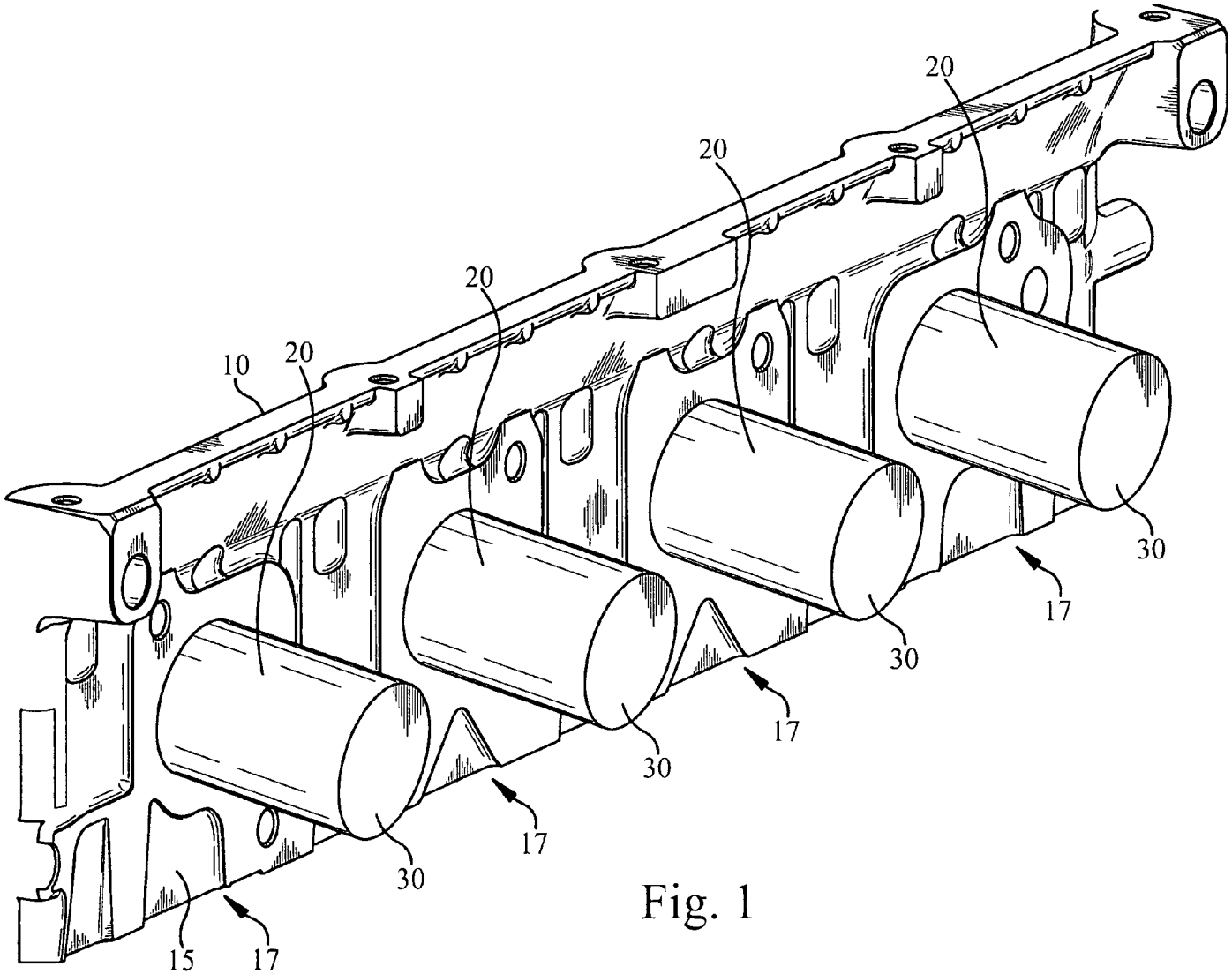
FIG. 1 illustrates a perspective view of an embodiment of an exhaust side of a cylinder head in accordance with the present invention.

Referring now to FIG. 1, an exhaust side 15 of a cylinder head 10 is shown. The cylinder head 10 is positionable atop cylinders of the combustion chambers of an engine (not shown). The cylinder head 10 is important to the performance of the engine as the shape of the combustion chamber, inlet passages and exhaust determine the efficiency of the engine.

Tubes 20 extend from the exhaust side 15 of the cylinder head 10. Each tube 20 provides fluid communication between an exhaust port 17 of the cylinder head 10 and a primary pipe of an exhaust manifold such that exhaust gases exiting the cylinder head 10 are transferred through the tubes 20 into the exhaust manifold (not shown).

In a preferred embodiment, the tubes 20 are integrally formed with the cylinder head 10. For example, the tubes 20 may be cast into the exhaust side 15 of the cylinder head 10. Advantageously, casting or otherwise integrally forming the tubes 20 with the cylinder head 10 eliminates the need for a manifold gasket. In addition, integrally forming the tubes 20 into the cylinder head 10 eliminates the need to weld each of the tubes 20 to the manifold flange and secure the manifold flange to the cylinder head 10. Accordingly, integrally forming the tubes 20 with the cylinder head 10 provides a manufacturing cost savings over prior art cylinder heads and manifold assemblies.

Each of the tubes 20 may be integrally formed with one of the exhaust ports 17 of the cylinder head 10 such that each combustion chamber of the engine corresponds to one of the tubes 20. As a result, the tubes 20 provides less stress on the cylinder head 10 than the prior art tubes that are bonded to a flange and bolted to the cylinder head 10. The performance of the engine is also improved over the prior art as the interior of the tubes 20 can remain smoother. For example, in the prior art, the tubes 20 are welded to a manifold flange resulting in at least a portion of the weld pool blocking exhaust flow through the tubes 20. Therefore, the tubes 20 of the present invention have a smoother interior and increased performance over prior art cylinder head and tube assemblies.

The tubes 20 may be constructed of metal or a metal alloy, such as, cast iron, cast aluminum, a composite material, or the like. The interior of each tube 20 may be machined so as to provide a smoother interior surface to reduce energy loss due to wall friction and thereby increase efficiency and engine performance. Also, as shown in FIG. 1, each tube 20 may be substantially perpendicular to the exhaust side 15 of the cylinder head 10; however, it will be appreciated that each tube 20 may be at any suitable angle relative to the exhaust side 15 of the cylinder head 10.

Additionally, as shown in FIG. 1, each tube 20 may have a circular cross-section; however, it will be appreciated that each tube 20 may have any suitable cross-section, such as elliptical, triangular, rectangular, square, hexagonal, octagonal or the like.

Forming independent tubes 20 may allow flexibility in system design; for example, in one embodiment, the tubes 20 may be of substantially different lengths, cross-sections, and/or at different angles relative to the exhaust side 15 as may required by the overall engine compartment and packing design thereby allowing more flexibility in exhaust manifold design and arrangement. In addition, separate tubes 20 may act as longer runners thereby permitting better flow separation and scavenging of the exhaust gases prior to the gases entering the exhaust manifold, which may increase overall engine performance. For example, the tubes 20 may have distinct lengths and each connect to the primary exhaust pipe at different locations.

The distal end 30 of each of the tubes 20 is in fluid communication with and coupled to a corresponding primary pipe of the exhaust manifold. Each of the tubes 20 may be coupled to one another and the primary pipe via a clamp (e.g. band clamp, v-band, Torca™ clamp, etc.), welding, press fit, threaded fit, an adhesive, or in another manner as will be appreciated by a person of ordinary skill in the art. Further, the distal end 30 of each of the tubes 20 may be flared so as to telescopically receive a corresponding primary pipe of the exhaust manifold; alternatively, the distal end 30 of each of the tubes 20 may be narrowed to be telescopically received by a corresponding primary pipe of the exhaust manifold.

A method for manufacturing and assembling a cylinder head 10 is also provided. A user may cast, mold, die-cast, or otherwise integrally form the tubes 20 to the cylinder head 10. The tubes 20 may have predetermined lengths, each of the tubes 20 have similar lengths of different lengths. The tubes 20 may be connected to a primary pipe of the exhaust manifold such that exhaust gases exiting the cylinder head 10 are passed through the tubes 20 and into the exhaust manifold.

Advantageously, integrally forming the tubes 20 to the cylinder head 10 may eliminate the need for an inlet flange on the exhaust manifold and corresponding machining required on the exhaust side 15 of the cylinder head 10, as well as elimination of the manifold gasket, thereby and in part, possibly reducing the number of potential leak paths in the system. Alternatively, the distal end 30 of each tube 20 may include a flange that may be coupled to a corresponding inlet flange of an exhaust manifold.

Having shown and described the preferred embodiment, further adaptations of the methods and systems described herein may be accomplished by appropriate modifications by one of ordinary skill in the art without departing from the scope and principles of the present invention. Several potential modifications will become apparent to those skilled in the art. Accordingly, the scope of the present invention should be considered in terms of the following claim and is understood not to be limited to the details of the embodiment shown and described above.

The invention claimed is:

1. An exhaust system for an internal combustion engine, the exhaust system comprising:

a cylinder head having an exhaust side for transferring exhaust gases from the engine, the cylinder head having a plurality of exhaust ports on the exhaust side;

a plurality of tubes unitarily formed with the cylinder head, each of the tubes having a proximate end and a distal end, the proximate end of each tube unitarily formed with the exhaust port of the cylinder head, and the distal end of each tube adapted to be connected to an exhaust manifold; and wherein the plurality of tubes are not unitarily formed with the exhaust manifold.

2. The exhaust system of claim 1 wherein at least one of the tubes is substantially perpendicular to the exhaust port of the cylinder head.

3. The exhaust system of claim 2 wherein tubes are unitarily formed with the cylinder head by casting or molding the tubes and the cylinder head as a single component.

4. The exhaust system of claim 3 wherein each of the tubes is separate and independent.

5. The exhaust system of claim 4 wherein one of the tubes has a first length and at least one of the other tubes has a second length that is different from the first length.

6. The exhaust system of claim 2 wherein the tubes have a substantially circular cross section.

7. The exhaust system of claim 1 wherein the tubes are connected to the exhaust manifold without use of a flange.

8. The exhaust system of claim 7 wherein the exhaust manifold provides fluid communication between at least two of the tubes.

9. The exhaust system of claim 8 wherein the tubes are die cast with the cylinder head to form a single component.

10. The exhaust system of claim 9 wherein the tubes are independently molded to the exhaust port of the cylinder head such that each exhaust port of the cylinder head corresponds to one of the tubes.

* * * * *